United States Patent [19]

Ohashi

[11] Patent Number: 5,044,571

[45] Date of Patent: Sep. 3, 1991

[54] APPARATUS FOR WINDING YARN

[75] Inventor: Kenji Ohashi, Uji, Japan

[73] Assignee: Murata Kikai Kabushiki Kaisha, Kyoto, Japan

[21] Appl. No.: 383,365

[22] Filed: Jul. 20, 1989

[30] Foreign Application Priority Data

Jul. 27, 1988 [JP] Japan ..... 63-187720

[51] Int. Cl.[5] ..... B65H 54/38; B65H 54/48

[52] U.S. Cl. ..... 242/18.1; 242/43.2

[58] Field of Search ..... 242/18.1, 43 R, 43.2, 242/158.3

[56] References Cited

U.S. PATENT DOCUMENTS 3,606,197 9/1971 Akers ..... 242/18.1 X
3,690,579 9/1972 Porter et al. ..... 242/18.1 X
4,767,071 8/1988 Hirai ..... 242/18.1

FOREIGN PATENT DOCUMENTS 79536 9/1950 Czechoslovakia ..... 242/43.2
426380 3/1926 Fed. Rep. of Germany ..... 242/43.2
232345 8/1944 Switzerland ..... 242/43.2

*Primary Examiner*—Stanley N. Gilreath
*Attorney, Agent, or Firm*—Spensley Horn Jubas & Lubitz

[57] ABSTRACT

A method and an apparatus for winding a yarn on a package in which the wind number of the package is changed regularly or rapidly at random in relation to the traverse of the yarn. A traverse drum having a plurality of grooves of different wind number and a branch portion of the traverse grooves is used to wind the yarn.

5 Claims, 7 Drawing Sheets

APPARATUS FOR WINDING YARN

FIELD OF THE INVENTION

The present invention relates to a method and an apparatus for winding yarn on a package in a spinning frame provided with a winding device, an automatic winder, a two-for-one twister, a false twister or the like.

RELATED ART STATEMENT

For example, an automatic winder as shown in FIG. 8 is well known in which a spun spinning bobbin is wound back to form a cone package or a cheese package.

In such an automatic winder 20, a package 23 is driven in surface contact by a drum 22 having a surface formed with a traverse groove 21 for traversing yarn which is called a traverse drum, and, a yarn bobbin 24 is wound while traversing yarn. In a case where winding is carried out by the traverse drum 22, when the diameter D of the drum and the diameter R of the package are in a special relationship therebetween, in other words, when the diameter of the winding in a special relationship wherein the number of revolutions of the drum 22 and the package 23 is one integer or a multiple of one integer, the traverse period is synchronized with the winding period of the package, and wound yarns pass the same yarn running area and gather and are superposed on each other in the same location to produce a phenomenon known as ribbon winding.

In such ribbon winding, when the yarn is released in a later step, a sloughing or latching cut may result.

The diameter R (mm) of the package 23 producing the ribbon winding is generally obtained by the following equation.

$$R = D \times \frac{D_W}{P_W} \qquad \text{(a)}$$

where

D = Diameter of drum (mm)

DW = Wind number of drum

PW = Wind number of package

For example, in a case in which D = 100 mm, DW = 2 winds, and PW = 1 wind, the diameter R1 producing the ribbon winding is 100×2/1 = 200 (mm). Namely, the ribbon windings 25 and 26 as shown in FIG. 9–FIG. 10 are produced, when the diameter of the package 23 is 200 mm.

In this case, there is only one crossing point C between the left-moving yarn and the right-moving yarn during one traverse with the point A as a starting point. Accordingly, in releasing such a package, yarn from one cross point C to the next cross point C is, as it were, free, and thus a sloughing or latching cut tends to result in a high-speed release.

Various types of devices for preventing ribbon winding have been proposed and are now in operation.

For example, there are types of automatic winders in which a package is mechanically moved to and from a drum to allow the surface of the package to slip for scattering yarns, in which a brake is periodically applied to a drum to produce slip, and in which a portion in the vicinity of a diameter where a ribbon winding occurs is detected, and the ribbon winding preventing device is actuated only in a danger area, as disclosed in Japanese Patent Application Laid-Open No. 161681/1987.

The package wound by operation of a conventional ribbon winding preventing device as described above exhibits a ribbon winding reducing effect to some extent, but cannot sufficiently withstand more recent high-speed releases. That is, for example, in the yarn release of a package supplied to warpers, there arises no significant problem at a release speed of 300 to 600 m/min. However, in recent high-speed releases of 600 to 1,000 m/min, troubles such as sloughing occur. Further, in high speed looms, for example, of the type in which the weft is fed by an air jet and the release speed is 800 to 1,500 m/min, a frequent occurrence of said troubles is becoming a significant problem.

OBJECT AND SUMMARY OF THE INVENTION

It is an object of the present invention to provide a method and an apparatus for winding a yarn to produce a wound package which is free from sloughing or latching cut, when the yarn on the package is released at high speed in a later step.

It is another object of the present invention to provide a method and an apparatus for winding a yarn on a package to produce a wound package having many crossing points of the yarn, by displacing the yarn which is to be passing a certain course, regardless of the diameter of the package.

In accordance with the present invention, these and other objects are achieved by providing a method for winding a yarn on a package while traversing the yarn which comprises the step of changing the wind number on the package regularly or at random, in relation to the traverse of yarn.

According to the present invention, an apparatus for winding a yarn on a package includes a traverse drum having a plurality of traverse grooves with different wind-numbers and a branch portion of the traverse groove, in which a yarn is displaced to another traverse groove to be changed to another yarn running area corresponding to the traverse groove.

DETAILED DESCRIPTION OF PREFERRED EMBODIMENTS

Hereafter, a method and an apparatus of this invention will be described with reference to the drawings.

An apparatus for carrying out the method according to the present invention will be described with reference to FIGS. 1 to 5.

Figure 1:
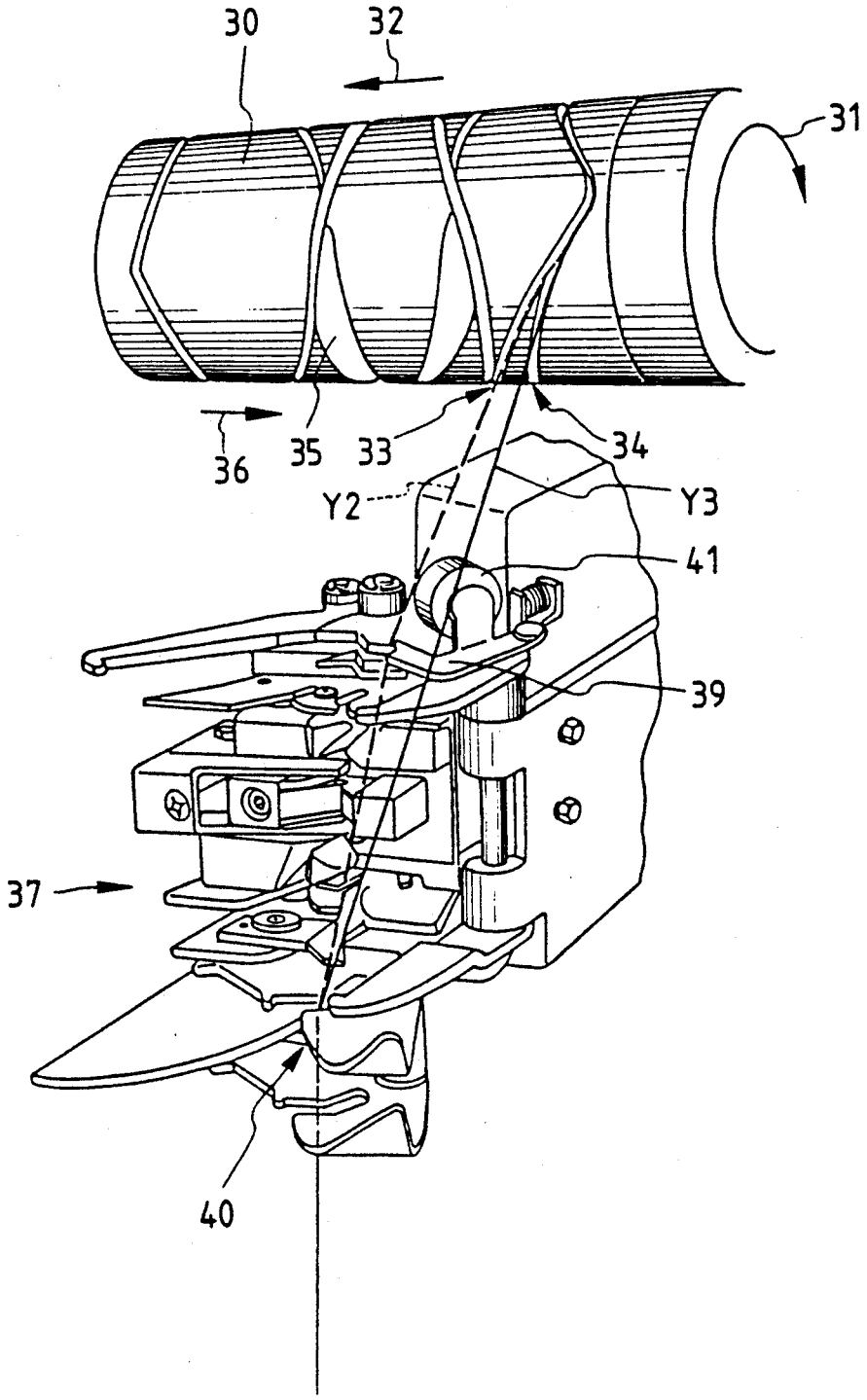
FIG. 1 is a perspective view showing one example of an apparatus embodying the present invention.

FIG. 1 is a perspective view showing parts of an apparatus for winding, and shows a drum 30 for directly traversing a yarn.

Traverse grooves formed in the drum 30 are in the form of grooves having different wind numbers. That is, grooves 33 and 34 having different wind numbers are formed so that when the drum 30 is rotated in a direction as indicated by arrow 31, and when a yarn is traversed in a direction as indicated by arrow 32 from right to left, the yarn is traversed by either groove 33 having 2 winds or groove 34 having 3 winds of the drum. The traverse in a direction as indicated by arrow 36 from left to right is effected along the traverse groove 35 having 3-winds. Reference numeral 37 designates a yarn splicing device provided on the winder.

While in the present embodiment, as the wind-number of the traverse grooves formed in the drum 30, an example of 2 winds and 3 winds is shown for ease of description, it is to be noted of course that a combination of different wind numbers can be employed. For example, 3 winds and 4 winds, and 1.5 winds and 2 winds and the like are possible. Furthermore, while in the drum shown in FIG. 1, the traverse groove from right to left has 2 winds and 3 winds, it is to be noted likewise that the traverse from left to right can be effected by the traverse grooves having different wind numbers.

Figure 2:
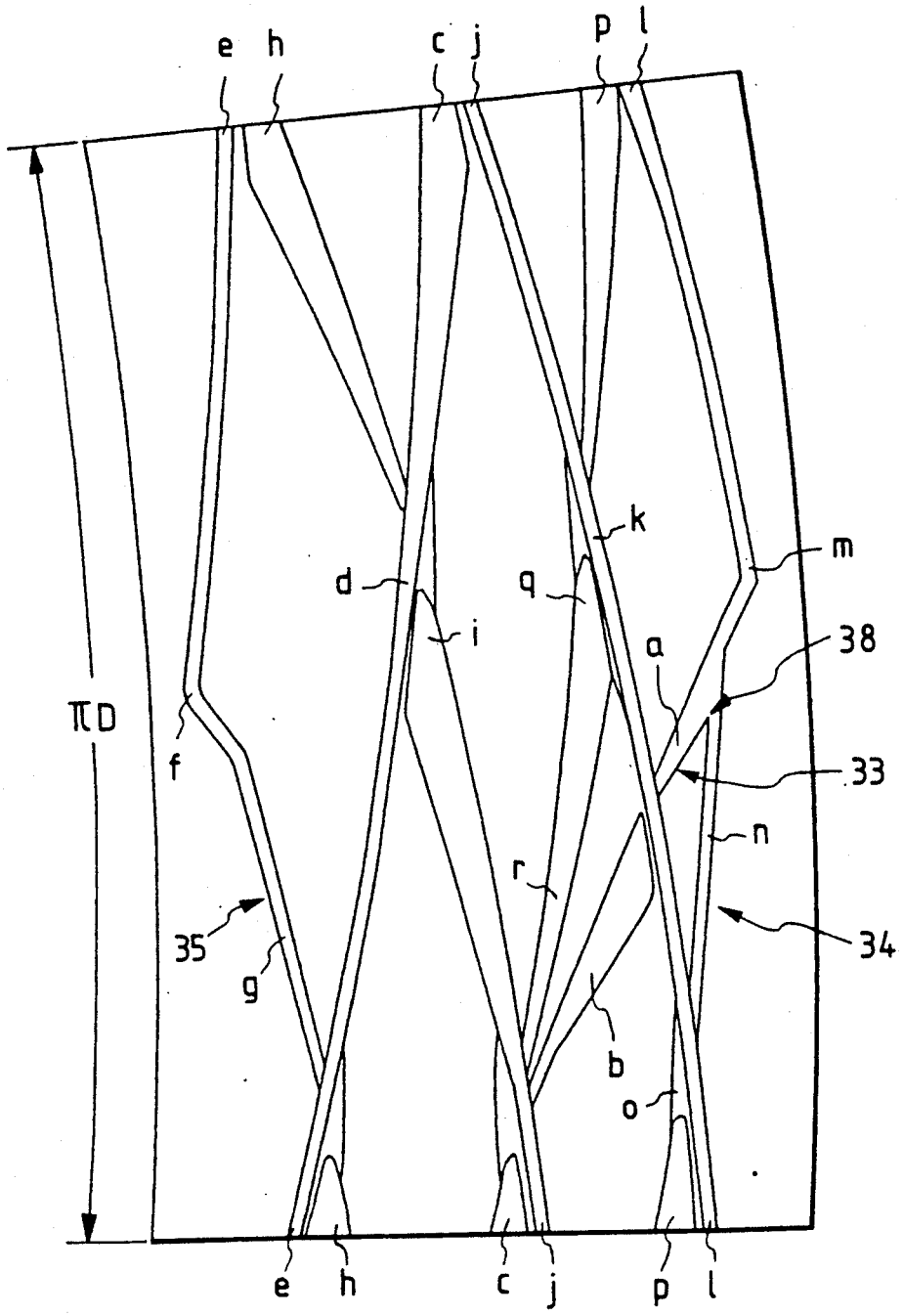
FIG. 2 is a developed view of a traverse drum used in the apparatus in FIG. 1.

FIG. 2 is a developed view of the drum 30 shown in FIG. 1. As the traverse grooves from right to left, a groove 33 for 2 winds and a groove 34 for 3 winds are formed, and a branch portion 38 to said two kinds of grooves are formed in the vicinity of the return end at the right end in the drum. That is, the grooves 33 for 2 winds are those indicated by reference characters a, b, c, d, e and f, and the grooves 34 for 3 winds are those indicated by n, o, p, q, r, c, d, e and f, a part of which is used in common. The grooves 35 for the traverse from left to right are those indicated by g, h, i, j, k, l and m, which are, in this case, 3-wind grooves.

Accordingly, in a branch portion 38 in the grooves a and n, the wind numbers of yarn wound on the package vary depending on the movement of yarn to be guided into the groove a or n. That is, in case of the yarn running area Y3 indicated by the solid line in FIG. 1, the wind numbers from right to left are 3 winds; and in case of the yarn running area Y2 indicated by the broken line, wind numbers are 2-winds.

The switching means for the yarn running areas Y2 and Y3 will be described hereinafter.

As a first means, passive switching means by way of tension adjustment of the yarn can be applied. That is, the yarn running area may be automatically switched by the inertial force resulting from the traverse motion of the yarn or the variation of the tension of yarn. For example, experiments have revealed that, in a case in which a tensioning device of the known type is used and in which yarn is nipped between two pressing plates to change a tension value, when the tension value is small, the probability of the yarn entering the 3-wind groove is larger than that of the yarn entering the 2-wind groove, whereas when the tension value is large, the state is reversed. Accordingly, the value is set to an approximately intermediate tension value whereby the yarn is moved into the grooves a and n with a probability of 50%.

Figure 3:
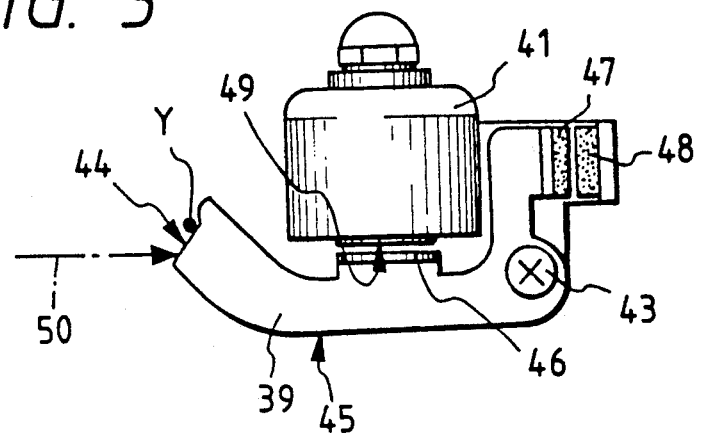
FIG. 3 is a plan view showing one example of positive means for switching yarn to a groove of a traverse drum having different wind-number.
Figure 4:
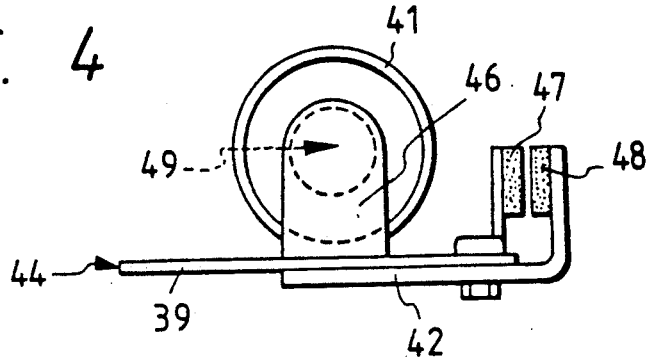
FIG. 4 is a front view of the same.

As a second switching means, positive switching means by way of mechanical means can be applied, one example of which is shown in FIG. 1 and FIGS. 3 to 5. That is, on the side of a branch portion 38 for the grooves a and n in the drum 30 and within the traverse area of yarn there is provided a movable guide 39 for defining a yarn running area. The movable guide 39 is located between the drum 30 and a guide member 40 in the traverse center of the yarn, and may be moved to two positions by means of an electromagnet, or solenoid 41. In FIGS. 3 and 4, the movable guide 39 is pivoted about 43 on a fixed plate 42.

One end of the movable guide 39 is formed to be a first guide edge 44 for locating yarn Y at the traverse end slightly inwardly of the normal traverse end, and the intermediate portion is formed to be a second guide edge 45 for guiding yarn to the normal traverse end, and an attraction member 46 to be attracted by the solenoid 41 is provided at the intermediate portion.

To the other end of the guide 39, a magnet 47 is secured oppositely of a magnet 48 provided on the fixed plate 42. The magnets 47 and 48 are urged in a repelling direction when they each have the same poles 20 (S—S or N—N). Namely, when the solenoid 41 is energized and the attraction member 46 of the movable guide 39 is attracted on the attraction surface 49 of the electromagnet, the magnets 47, 48 are moved toward each other to increase the repelling force; and when the electromagnet is deenergized, the movable guide 39 is instantaneously returned to its original position by the aforesaid repelling force.

Accordingly, when the movable guide 39 is at the position shown in FIG. 3, or the solenoid 41 is off, the yarn Y traverses rightward along the arrow 50 and is impeded by the first guide edge 44, as a consequence of which the yarn Y takes the yarn running area Y2 shown in FIG. 1. Accordingly, the yarn after being returned moves into the groove a for 2 winds.

Figure 5:
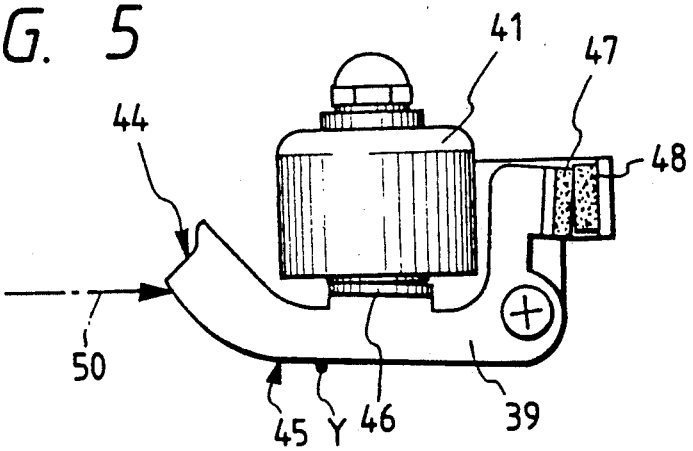
FIG. 5 is a plan view showing the operating state of said means.

On the other hand, when the movable guide 39 is at the position shown in FIG. 5, or the solenoid 41 is on, the movable guide 39 is displaced, and the yarn Y for the rightward traverse along the arrow 50 is moved to the normal traverse end along the second guide edge 45 without being impeded by the first guide edge 44. As a result, the yarn running area assumes the solid line position Y3 in FIG. 1, and the yarn after being returned is moved into the groove n for 3 winds.

Accordingly, if the movement of the movable guide 39 is effected every traverse, the yarn alternately repeats a 2-wind winding and a 3-wind winding every traverse. Timing of on and off of the electromagnet can be set to a suitable time, and the repeat frequency of the 2-wind winding and the 3-wind winding can be suitably set. Moreover, the 2-wind winding and the 3-wind winding can be changed periodically or at random, but it is preferably set so that as a whole, the 2-wind winding and the 3-wind winding are respectively 50%.

One example of means for alternately effecting a 2-wind winding and a 3-wind winding every traverse will be illustrated.

Figure 11:
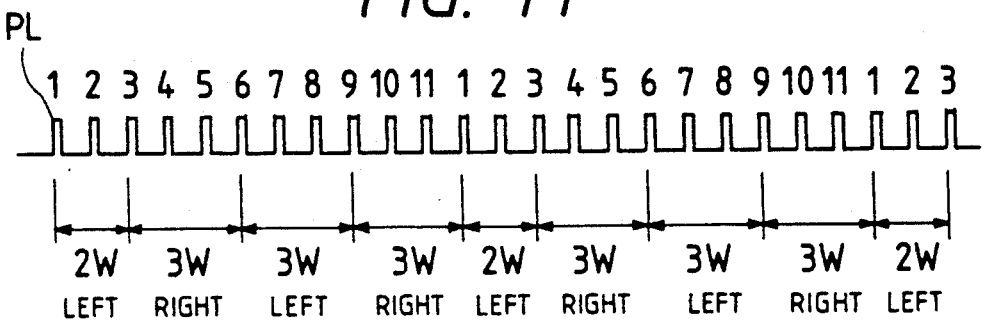
FIG. 11 is a diagram showing a pulse signal of a drum sensor.
Figure 12:
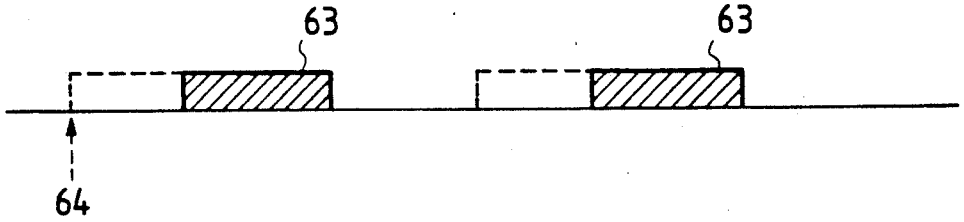
FIG. 12 is a diagram showing timing for turning on and off a solenoid according to the pulse of the drum sensor.
Figure 13:
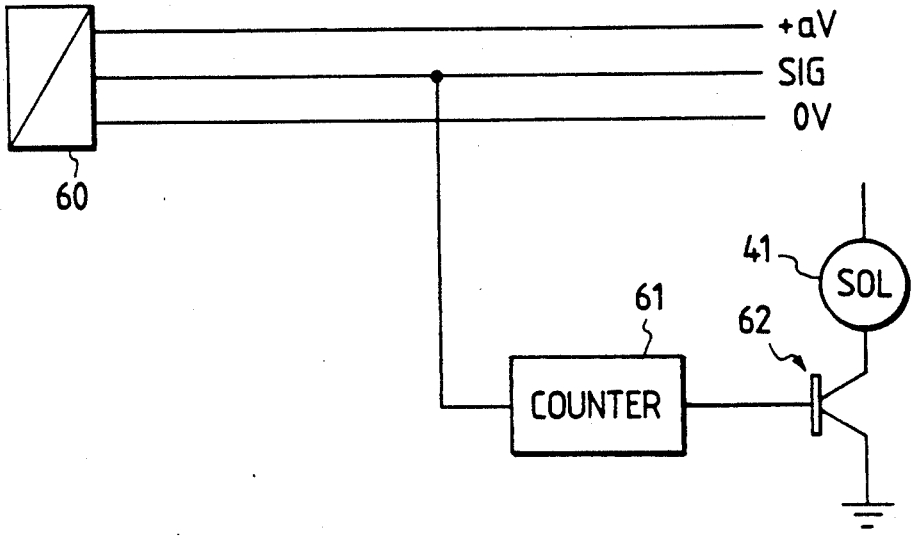
FIG. 13 is a view showing one example of a circuit for embodying the turning on and off in FIG. 12.

As shown in FIGS. 11 to 13, a drum sensor 60 which generates one pulse PL every rotation of a traverse drum is provided, and the rotation of the drum is operatively associated with the on-and-off of a solenoid 41 of the movable guide 39. That is, 11 pulses in the drum pulse signal consisting of one cycle, and a counter 61 and a contact 62 are provided in a solenoid circuit so that the solenoid 41 is turned on only when the drum sensor 60 generates the 5th to 9th pulses, as shown by reference numerals 63 and 64 in FIG. 12. That is, in the above-described embodiment, the groove for 2 winds and the groove for 3 winds are formed in the drum. Therefore, in the 2-wind groove, the drum is rotated twice and the yarn traverses from right to left, and in the rightward 3-wind groove, the drum is rotated three times and the yarn traverse from left to right. Accordingly, if the solenoid 41 is turned on in the midst of the rightward mode, the movable guide is attracted and the yarn moves as shown by the letter Y of FIG. 5, and when reversed, the yarn is moved into the groove 34 for the rightward 3 winds. As a result, the wind numbers of package for one way portion are repeated with 2 winds, 3 winds, 3 winds and 3 winds as one cycle.

When yarn is released from the thus wound package, the wind numbers of yarn released from left to right is an alternating and repeating pattern of a 2-wind and a 3-wind (i.e., 2-wind, 3-wind, 2-wind, 3-wind, 2-wind, 3-wind, etc.). The solenoid may be turned at 64 by the pulse PL2 when the yarn is moved leftward along the 2-wind groove as indicated by the broken line in FIG. 12.

Other than the above-described switching means for changing the wind numbers using the electromagnet, various means can be applied. For example, the movable guide 39 is moved by a rotatary cam, or an air jet nozzle is provided at a position of the movable guide 39 to intermittently jet air against yarn coming to the traverse end to thereby provide two yarn running areas Y2 and Y3 shown in FIG. 1.

Figure 6:
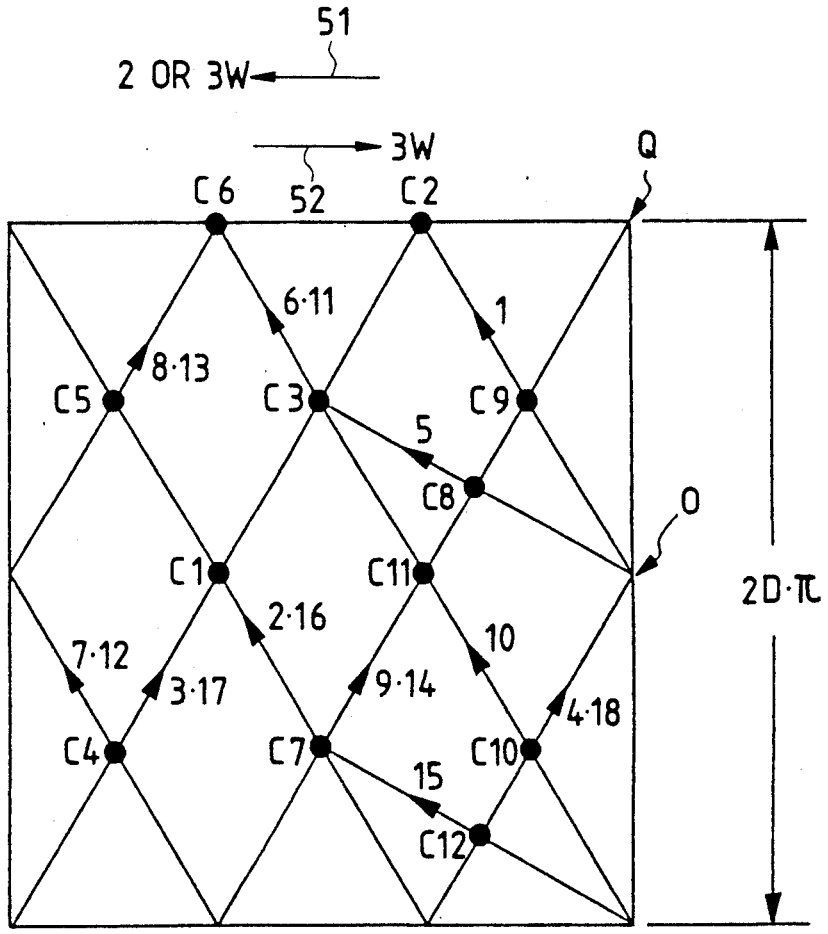
FIG. 6 is a developed view showing a yarn running area in the ribbon-wind producing diameter of a package wound according to the method of the present invention.

The method for winding yarn by using the winding device shown in FIG. 1 will be described with reference to FIG. 6. FIG. 6 is developed view of a package, and shows the wound state of the package of the diameter 2D, being produced by using the traverse drum of the diameter D having the groove shown in FIG. 2, and the movable guide 39 as the switching device. In case of leftward mode 51, switching is made to the groove for 2-wind and groove for 3-wind whereas in case of rightward mode 52, only the 3-wind is present. Accordingly, assume now that the point 0 at the right end is a start point of traverse, yarn passes from the yarn running area 1 for 3-wind and returns to the point 0 through 2→3→4 in said order. When the movable guide 39 is located at the position of FIG. 3, in the succeeding leftward mode, the yarn is moved into the groove a for 2-wind as mentioned above and passes from the yarn running area 5 and returns to the point Q at the right end of the package through 6→7→8→9. At this time, if the movable guide 39 is again moved to be located at the position of FIG. 5, the yarn passes the yarn running area for 3-wind 10→11→12→13→14.

Furthermore, by the movable guide shown in FIG. 3, the yarn passes the yarn running area for 2-wind 15→16→17→18 and returns to the original starting point 0. That is, the yarn is returned to the original position with four traverses returning to the original start position 0. That is, the yarn is returned to the original position with four traverses.

Accordingly, twelve crossing points of yarn in order of C1→C2→C3 . . . →C12 are made between the four traverses. For example, at the crossing point C1, yarns produced thereat are yarns indicated by numerals 2 and 3, which are crossed so that the yarn 3 having larger number is positioned on the yarn 2 having smaller number. The same is applied to other crossing points.

Figure 7:
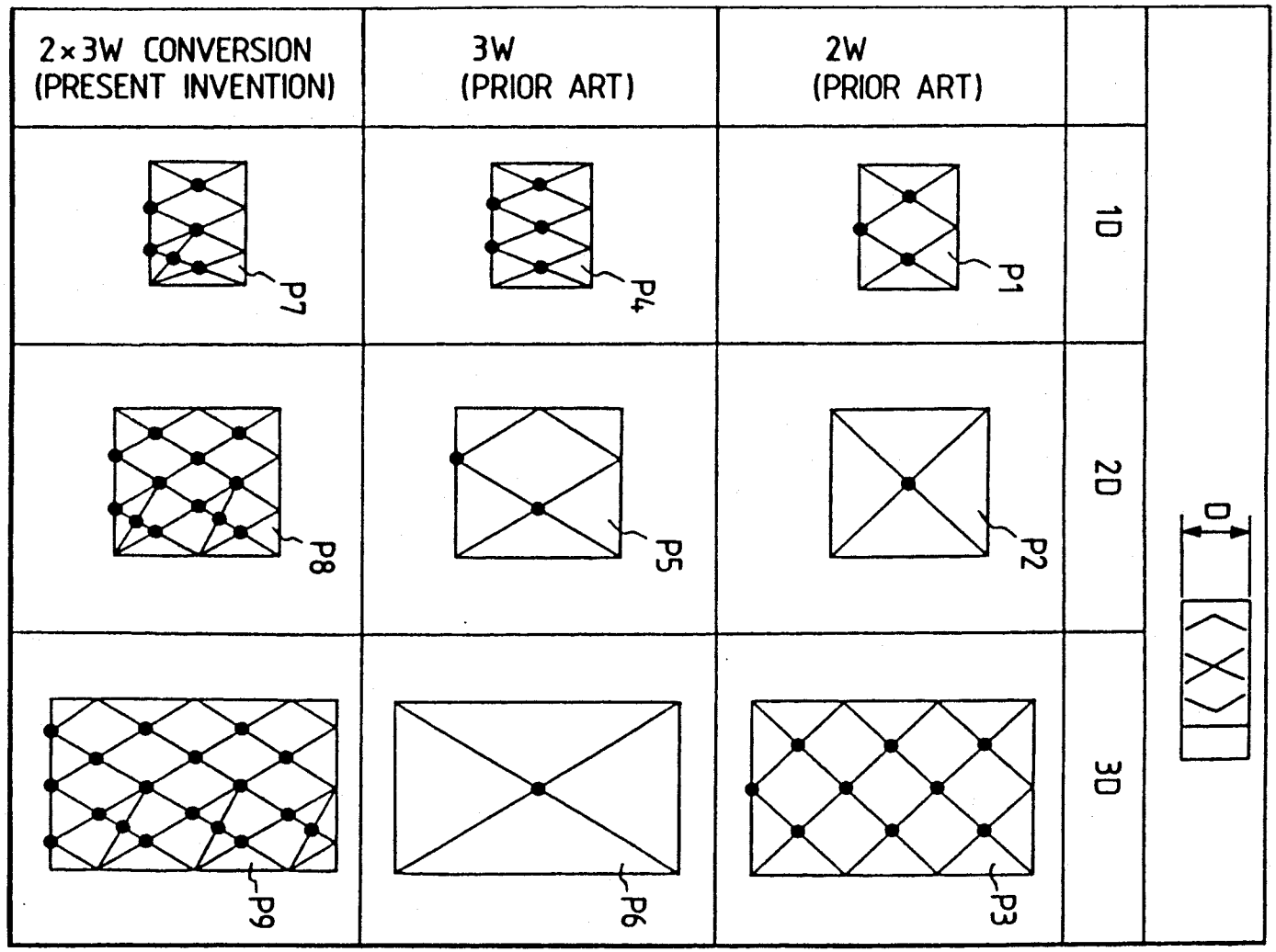
FIG. 7 is a schematic developed view showing a difference in yarn running area between a conventional wound package and the wound package according to the present invention.
Figure 8:
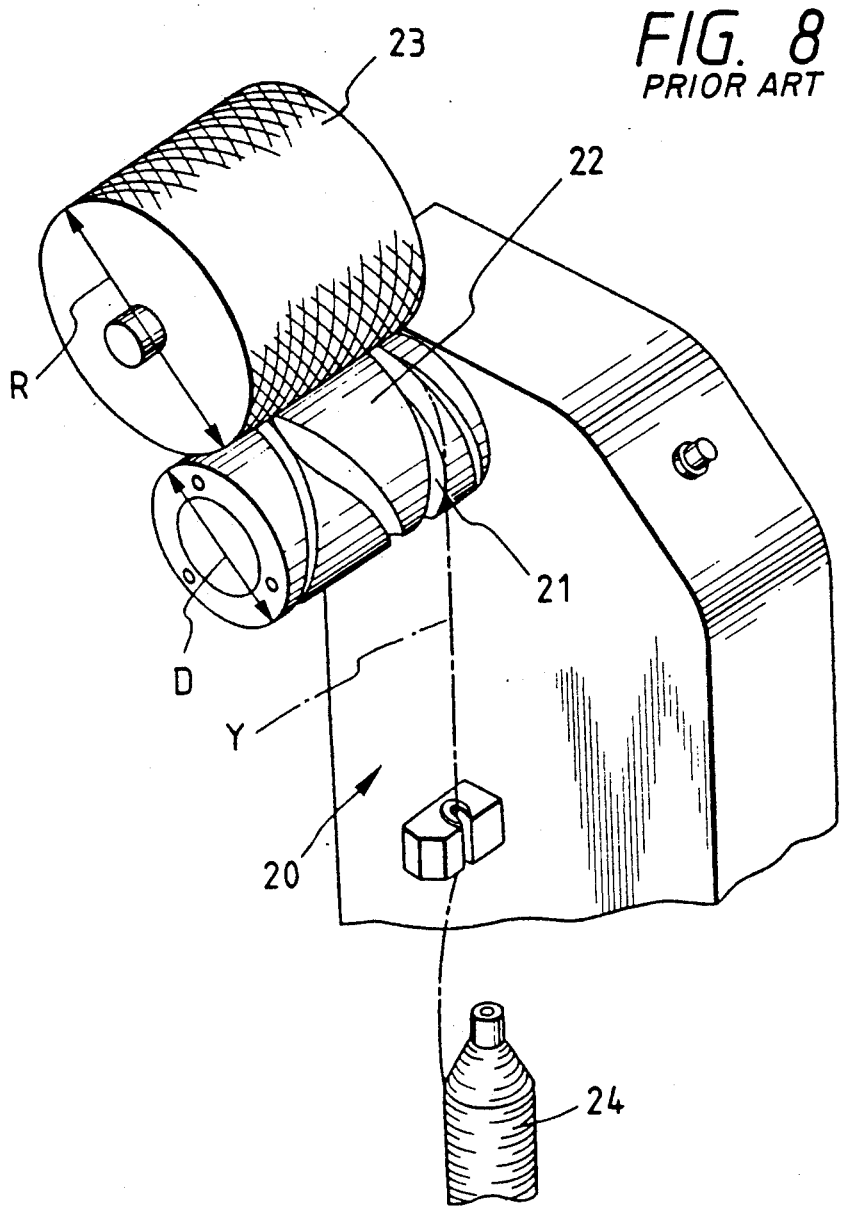
FIG. 8 PRIOR ART
FIG. 8 is a perspective view showing one example of a conventional winding apparatus.
Figure 9:
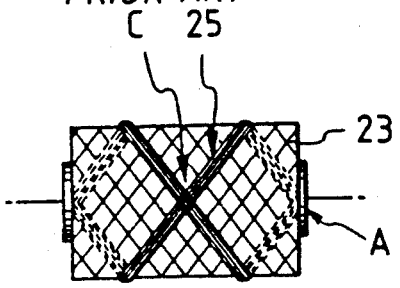
FIG. 9 PRIOR ART
FIGS. 9 and 10 are respectively front views of packages showing the ribbon winding state in the ribbon-wind producing diameter obtained by the conventional apparatus.
Figure 10:
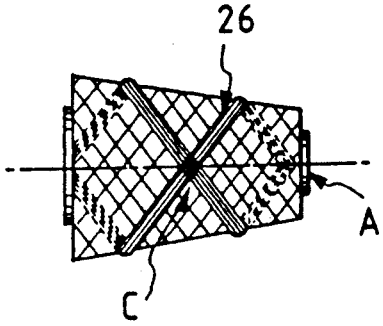
FIG. 10 PRIOR ART

FIG. 7 shows the state of the crossing points in the ribbon-wind producing diameter of a wound package by a conventional winder and the present invention. There are shown the case of prior art in which for example, the diameter of the traverse drum is D, and the wind numbers of the drum are 2 winds and 3 winds in both backward and forward, and the case of the drum shown in FIG. 2 according to the present invention. That is, in the conventional 2-wind drum, there is a package P2 having one crossing point at a position where the diameter of the package is 2D, whereas in the present invention, there is a package P8 having 12 crossing points at a position where the diameter of the package is 2D. In the conventional 3-wind drum, there is a package P6 having one crossing point at a position where the diameter of the package is 3D, whereas in the present invention, there is a package P9 having 18 crossing points at a position where the diameter of the package is 3D. That is, smaller in number of crossing points, the yarn running area in the diameter of ribbon-wind passes the same course, and therefore the density of the ribbon-wind is large and many yarns pass the same course to assume a state in which the yarn running area is largely projected, and a variation in tension at the time of release becomes remarkably. On the other hand, where there are many crossing points in the ribbon-wind producing diameter as in the packages P8 and P9, the number of yarns passing the same course is small, and accordingly, the ribbon is scattered, thus a variation in tension at the time of release is reduced, and sloughing and entanglements are hard to occur.

The scattering degree of the wind number of the package obtained by the winding apparatus according to the present invention is given in Table 1. Experiments were conducted in the procedure such that cotton yarn of Ne40 was used, the yarn speed was 1,000 m/min., and the switching means for grooves for 2-wind and 3-wind of the traverse drum used were passive means by way of tension of yarn and positive means by means of the switching movable guide 39 shown in FIG. 1. In Table 1, in case of the passive means, when the tension value is set to 15 g, yarn is slowly released from the wound package to examine if it is 2-wind or 3-wind by an operator. When the wound yarn on the package P8 shown in FIG. 7 is released from left to right, it is found that the numbers of yarn of 2-wind are three and those of 3-wind are seven as in 3, 2, 3, 3, . . . 3, 3; as shown in the uppermost column in Table 1.

In case of the tension value of 15 g, it was found that the numbers of yarn of 2-wind were 19 and those of 3-wind were 31, and the ratio of 2-wind to 3-wind was 38% and 62%. Furthermore, it was found that the ratio of 2-wind to 3-wind was 52% and 48% when the tension value was 23 g, and the ratios of 2-wind to 3-wind were 72% and 28% when the tension value was 30 g.

That is, a probability in which the 2-wind groove and 3-wind groove are automatically switched when the tension value is 23 g or so is ½.

On the other hand, in case of using the positive means, when the movable guide is actuated every traverse, 2-wind and 3-wind approximately alternately appear as shown in Table 1, and the wind numbers are evenly scattered. That is, the traversing yarn is stably switched to the grooves irrespective of the tension value.

TABLE 1

| Data of Ratios of 2 W and 3 W | | | | | | | | | | 2 W | 3 W |
|---|---|---|---|---|---|---|---|---|---|---|---|
| Passive | | | | | | | | | | | |
| Tension 15 g | | | | | | | | | | | |
| 3 | 2 | 3 | 3 | 2 | 3 | 2 | 3 | 3 | 3 | 3 | 7 |
| 3 | 3 | 3 | 2 | 2 | 2 | 2 | 2 | 3 | 3 | 5 | 5 |
| 3 | 3 | 3 | 3 | 3 | 3 | 3 | 3 | 3 | 3 | 0 | 10 |
| 2 | 3 | 3 | 3 | 2 | 2 | 2 | 2 | 2 | 3 | 6 | 4 |
| 2 | 2 | 2 | 2 | 2 | 3 | 3 | 3 | 3 | 3 | 5 | 5 |
| | | | | | | | | | | 19 times | 31 times |
| Tension 23 g | | | | | | | | | | | |
| 2 | 2 | 3 | 2 | 2 | 3 | 3 | 3 | 3 | 2 | 5 | 5 |
| 2 | 3 | 3 | 2 | 2 | 3 | 3 | 2 | 2 | 3 | 5 | 5 |
| 3 | 3 | 2 | 3 | 2 | 2 | 2 | 2 | 3 | 3 | 5 | 5 |
| 2 | 2 | 3 | 2 | 2 | 2 | 2 | 2 | 2 | 2 | 9 | 1 |
| 3 | 3 | 3 | 3 | 3 | 3 | 2 | 3 | 2 | 3 | 2 | 8 |
| | | | | | | | | | | 26 times | 24 times |
| Tension 30 g | | | | | | | | | | | |
| 2 | 2 | 3 | 2 | 2 | 2 | 2 | 2 | 2 | 2 | 9 | 1 |
| 3 | 3 | 3 | 3 | 2 | 2 | 2 | 2 | 3 | 2 | 5 | 5 |
| 2 | 2 | 2 | 2 | 2 | 3 | 2 | 3 | 2 | 2 | 8 | 2 |
| 3 | 2 | 3 | 2 | 2 | 2 | 2 | 3 | 2 | 3 | 6 | 4 |
| 2 | 2 | 2 | 2 | 2 | 2 | 2 | 3 | 3 | 2 | 8 | 2 |
| | | | | | | | | | | 36 times | 14 times |
| Positive | | | | | | | | | | | |
| 3 | 2 | 3 | 2 | 3 | 2 | 3 | 2 | 3 | 2 | 5 | 5 |
| 3 | 2 | 3 | 2 | 3 | 2 | 3 | 2 | 3 | 2 | 5 | 5 |
| 3 | 2 | 2 | 3 | 2 | 3 | 2 | 3 | 2 | 3 | 5 | 5 |
| 3 | 2 | 3 | 2 | 3 | 2 | 3 | 3 | 2 | 3 | 4 | 6 |
| 3 | 2 | 3 | 2 | 3 | 2 | 3 | 2 | 3 | 2 | 5 | 5 |
| | | | | | | | | | | 24 times | 26 times |

In the above explanation, the case where yarn is directly traversed by the traverse drum, it is to be noted of course that the present invention may be applied to a winder of the type in which a traverse guide is secured to a shaft extending between the winding units, and a cam shoe is fitted to a drum having a cam groove having different wind numbers similar to a groove formed in the drum at the end of the shaft to simultaneously traverse a plurality of yarns in the winding portion. In this case, positive switching means is needed to be provided for switching the cam shoe to the cam groove having different wind numbers, the movable guide shown in FIG. 1 being required to be provided at a position where the former is in contact with the cam shoe.

In the present invention as described above, in any ribbon-wind producing diameter, passing course of a yarn being scattered, the package having many crossing points of yarn can be produced.

Namely, according to this invention, the wound package by which smooth release may be effected can be produced, at the time of high-speed release.

What is claimed is:

1. An apparatus comprising:

a rotatable traverse drum including a first traverse groove having a first wind number and a second traverse groove having a second wind number, the first wind number being different than the second wind number, the traverse drum further including a branch portion at which a yarn to be wound on a package is selectively distributed to at least one of the first and second traverse grooves as the drum rotates; and switching means for distributing yarn at the branch portion to at least one of the first and second traverse grooves.

2. The apparatus as claimed in claim 1, wherein the switching means comprise a moveable guide operatively associated with the rotatable traverse drum.

3. The apparatus as claimed in claim 2, wherein the movable guide is located adjacent the branch portion and comprises a solenoid for moving the movable guide between at least two different positions.

4. The apparatus as claimed in claim 1, wherein the switching means comprises:

a movable guide, an attraction member secured to the movable guide, a solenoid for attracting the attraction member, and means for urging apart the movable guide and the solenoid.

5. The apparatus as claimed in claim 4, further comprising:

a drum sensor for detecting rotation of the drum, and means for actuating the solenoid in response to rotation of the drum.

* * * * *